United States Patent [19]

Cooper

[11] Patent Number: 4,489,635

[45] Date of Patent: Dec. 25, 1984

[54] SAW MILL IMPROVEMENTS

[76] Inventor: William B. Cooper, P.O. Box 550, Wadley, Ga. 30477

[21] Appl. No.: 475,930

[22] Filed: Mar. 16, 1983

[51] Int. Cl.[3] ..... B27B 7/00

[52] U.S. Cl. ..... 83/708; 83/433; 83/435.1; 144/209 A

[58] Field of Search ..... 83/708, 411 R, 435.1, 83/423, 424, 733, 425.2, 433, 437, 703, 704, 412, 409; 144/209 A, 208 G, 378

[56] References Cited

U.S. PATENT DOCUMENTS

| | | | |
|---|---|---|---|
| 2,352,885 | 7/1944 | Bukowsky | 144/208 G |
| 2,902,070 | 9/1959 | Latimer | 144/208 G |
| 3,129,733 | 4/1964 | Dargan et al. | 83/409 |
| 3,180,377 | 4/1965 | Pinder | 83/731 X |
| 3,503,428 | 3/1970 | Ackerfeldt | 83/409 |
| 3,747,455 | 7/1973 | Hartzell et al. | 83/708 X |
| 3,786,712 | 1/1974 | Mackin | 83/708 |
| 3,872,758 | 3/1975 | Hartzell et al. | 83/708 |
| 4,271,736 | 6/1981 | Jones | 83/412 X |
| 4,287,798 | 9/1981 | Cooper et al. | 83/708 X |

*Primary Examiner*—Donald R. Schran

*Attorney, Agent, or Firm*—Newton, Hopkins & Ormsby

[57] ABSTRACT

A saw mill for producing square cross section timber pieces is disclosed. The mill includes a log orientation mechanism having three, spaced independently operable log elevating units. The units include pairs of log supporting discs. The discs of one unit only are power driven to turn the log on its longitudinal axis. A log dogging, indexing and stabilizing mechanism includes a pair of carriage mounted units on an overhead trackway. One such unit carries a log supporting and precision indexing dog which is turned through ninety degrees of rotation between positive stops by a power cylinder. The same unit carries a log stabilizing dog above the indexing dog which is moved axially into and out of engagement with a log end face while being held against rotation by another power cylinder. The log orientation mechanism is compatible with state-of-the-art scanning and microprocessor devices and the log may simply be visually scanned during orientation by an operator of the mill.

15 Claims, 7 Drawing Figures

SAW MILL IMPROVEMENTS

BACKGROUND OF THE INVENTION

The present invention relates to improvements in a saw mill of the type disclosed in prior U.S. Pat. No. 4,287,798, issued Sept. 8, 1981 to Cooper et al. This class of saw mill is adapted to produce square cross section timber used for various purposes, including the production of railroad ties. A rough log must be arranged in an optimum cutting position taking into account natural irregularities by a log elevating and turning mechanism which can be called a log orientation mechanism.

One of the principal objects of this invention is to improve on the log orientation mechanism in the prior referenced patent, particularly in terms of a more positive means to turn the log on its longitudinal axis while engaging it in very narrow areas only so as to avoid contact to the greatest possible extent with nodules, limb stubs and other natural irregularities. In the referenced prior patent, the log undergoing orientation is engaged throughout its entire length so that contact with existing irregularities cannot be avoided. This, in turn, results in a less efficient and less precise optimum orientation of the log preparatory to cutting the log.

After optimum positioning of the log is achieved, the log must be dogged between its ends in preparation for a first pass through a pair of spaced rotating saw blades to remove a first pair of slabs from opposite sides of the log. Following retraction of the log transport dollies having the dogging means thereon, the log must be indexed ninety degrees in preparation for a second and final pass through the saw blades, where two more slabs are cut from the log to produce the desired square cross section timber for diverse usage.

A second principal object of this invention is to improve significantly on the dogging and indexing mechanism of the mill compared to the corresponding mechanism in the referenced prior patent. The improvement here is in two areas. First, the indexing mechanism in the present invention is not subject to any build up of rotational play as due to drive chain wear, and is very precise. Secondly, the dogged log is stabilized to a much greater degree before and after indexing and during its passage through the saw blades.

While the above are the principal improvement features over the prior art which the invention seeks to provide, other features and advantages will be recognized by those skilled in the art during the course of the following description. One such advantage of the invention over the prior referenced patent is the elimination of the need for frequent adjustment of the drive chain in the log indexing mechanism in the prior patent, such chain developing play during the usage of the mill. In the present invention, this problem is completely eliminated in the improved precision indexing and stabilizing mechanism.

DETAILED DESCRIPTION

Figure 1:
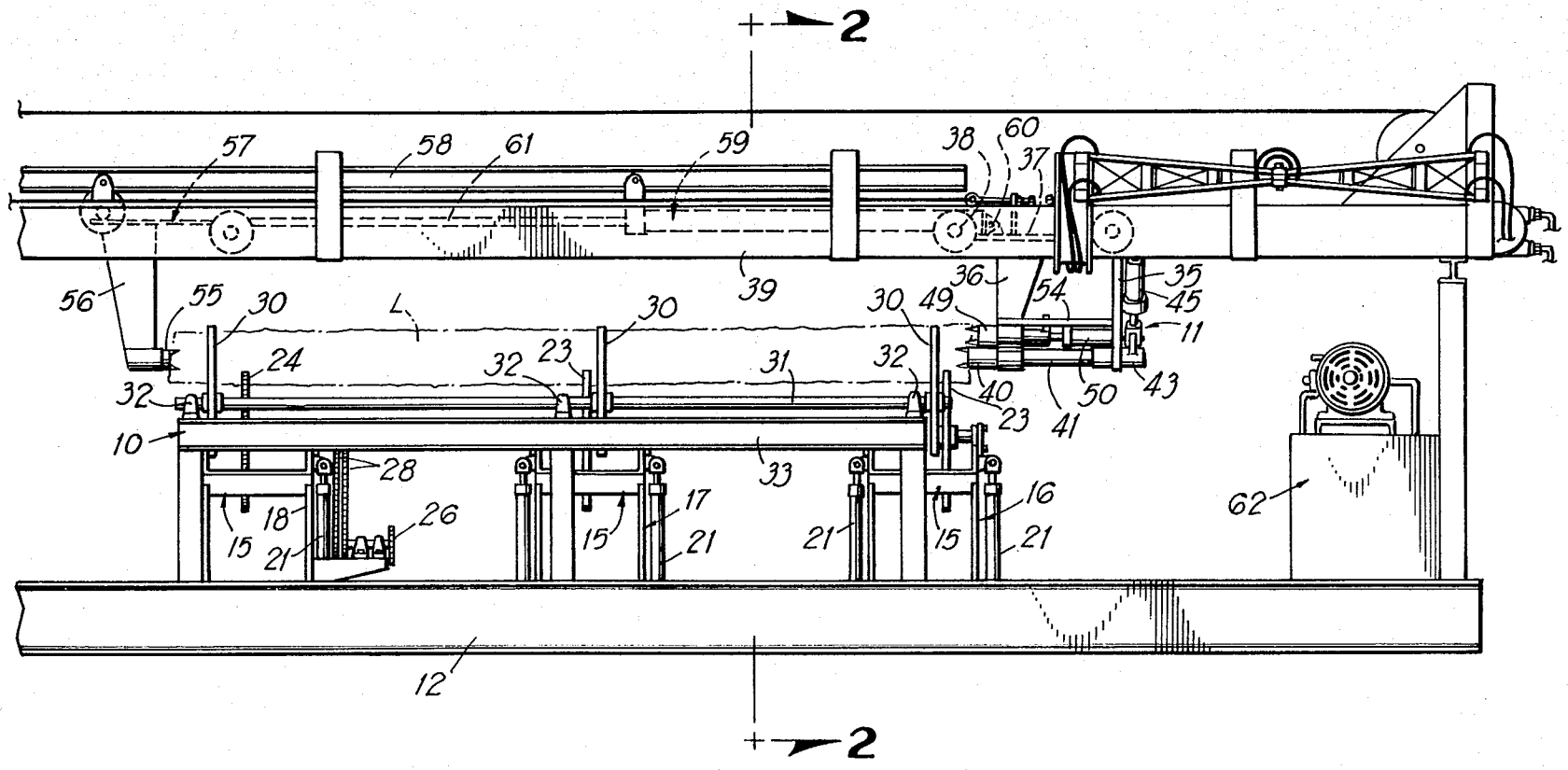
FIG. 1 is a fragmentary side elevation of a saw mill according to the present invention showing in particular the log orientation mechanism and the indexing and stabilizing log dogging mechanism.

Referring to the drawings in detail, wherein like numerals designate like parts, FIG. 1 illustrates the upstream end portion of a saw mill according to the invention where a log L is allowed to roll onto an orientation apparatus 10 whose construction and operation comprises an important aspect of the invention. FIG. 1 also depicts a log dogging, indexing and stabilizing mechanism 11 according to a second important aspect of the invention. The mechanism 11 is illustrated in the retracted position in FIG. 1 near one end of the mill and away from the downstream spaced saw blades, not shown. The saw blade arrangement and other features of the saw mill at its downstream portion may remain identical to the corresponding arrangement disclosed in U.S. Pat. No. 4,287,798, and consequently that end portion of the mill need not be shown or described herein.

Referring to the drawings in greater detail, the saw mill includes a base frame having longitudinal channel members 12 and interconnecting transverse frame members 13. Rising vertically from the frame members 13 are vertical I-beam track members 14 for the support and guidance of vertically movable carriages 15 of three separate spaced log orientation assemblies or units 16, 17 and 18. The carriage 15 of each orientation unit carries guide rollers 19 having guided engagement with flanges 20 of the I-beam tracks 14. Each vertically movable carriage 15 is independently raised and lowered by a pair of opposite side hydraulic cylinders 21 connected between base frame members 13 and brackets 22 on the carriages 15 near their tops.

Figure 3:
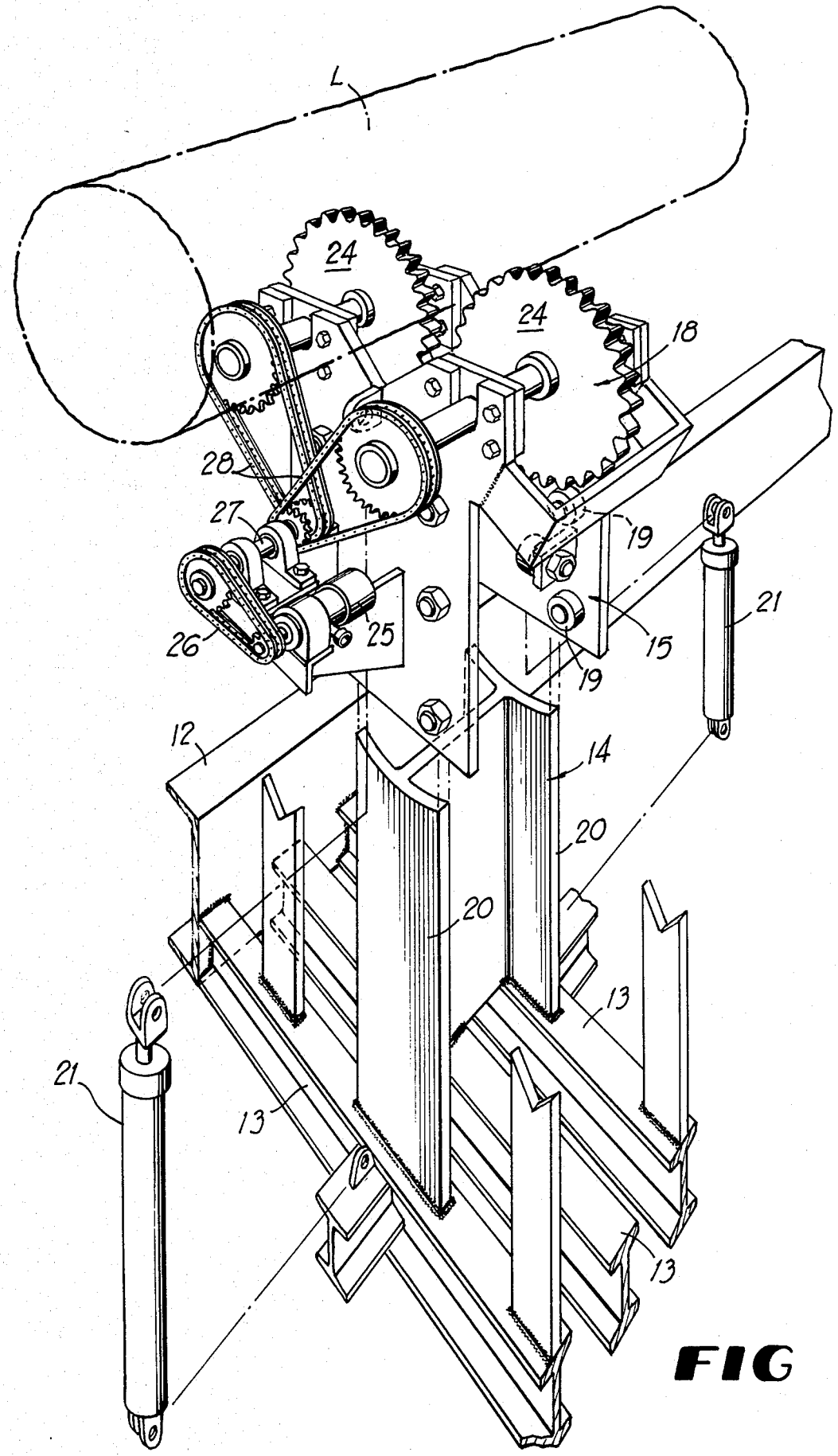
FIG. 3 is a perspective view showing the positive drive unit at one end of the log orientation mechanism.
Figure 5:
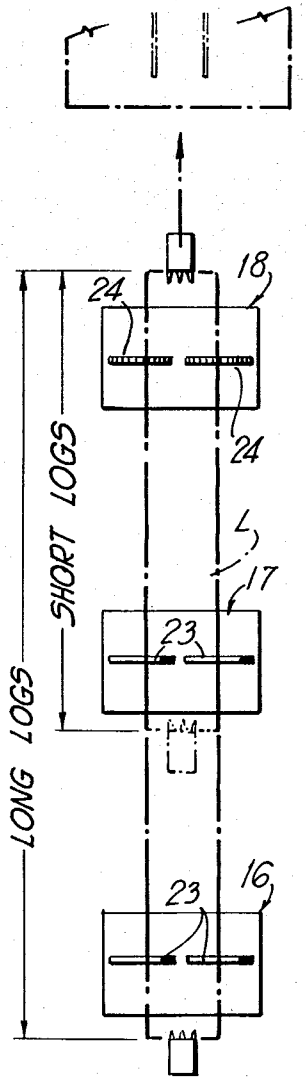
FIG. 5 is a fragmentary plan view of the log orientation mechanism for long and short logs.
Figure 4:
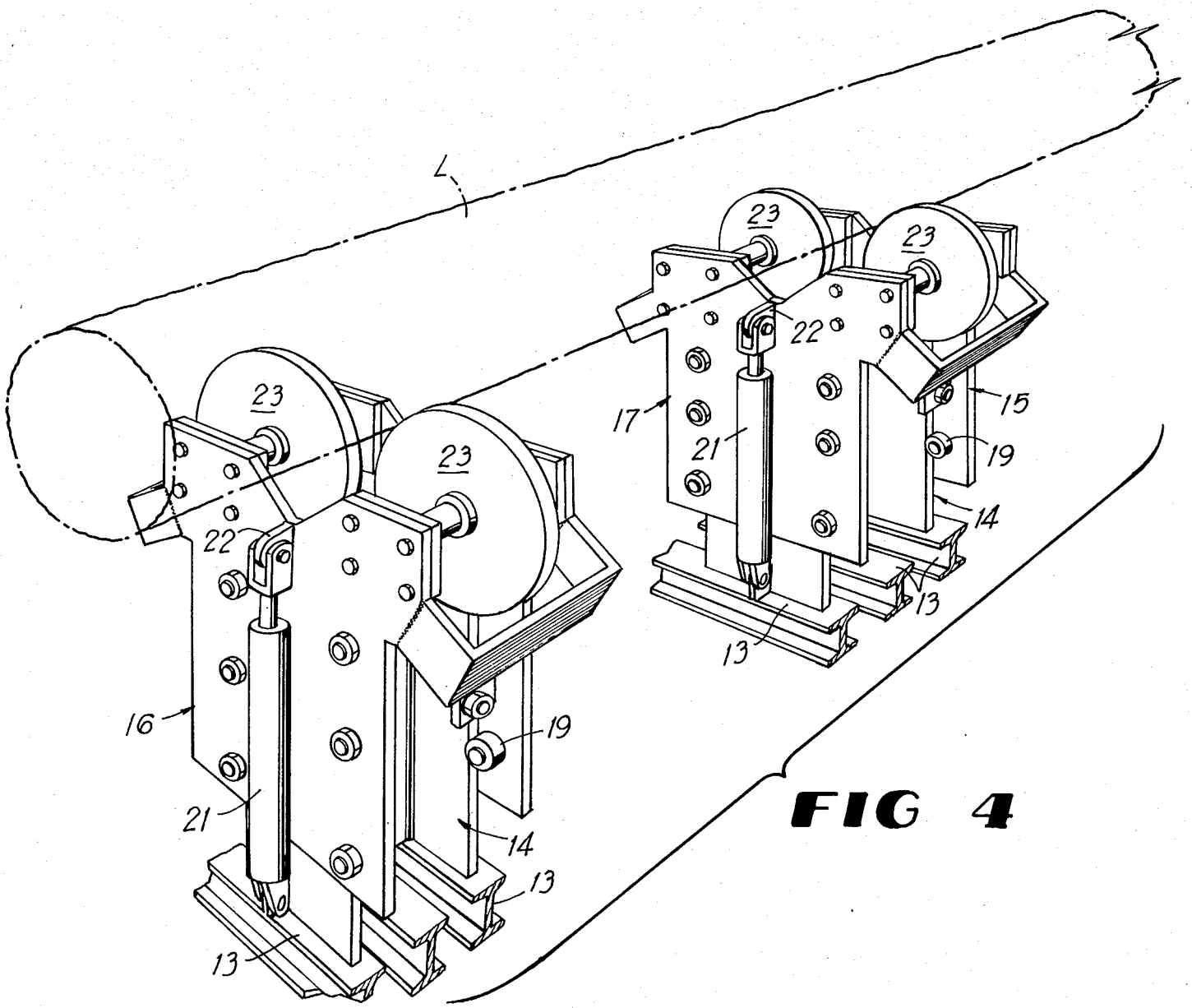
FIG. 4 is a further perspective view showing additional units of the log orientation mechanism.

The upstream and intermediate log orientation units 16 and 17 each carry at their tops a pair of laterally spaced equally sized freely rotatable log supporting discs 23 whose peripheries are smooth. The downstream orientation unit 18, however, is equipped at its top with a pair of spaced parallel axis log supporting discs 24 whose peripheries are toothed, as best shown in FIG. 3. The discs 23 and 24 on the respective orientation units 16, 17 and 18 are coaxial at a common elevation if the several carriages 15 are held at the same elevations by the cylinders 21. However, in practice, as indicated in FIG. 5, a pair only of the three orientation units is utilized at one time, depending upon whether the log undergoing orientation is long or short. If the log is long, the two end units 18 and 16 are employed to support and rotationally orient the log L to the optimum position for most efficient cutting. In this case, the intermediate unit 17 is lowered by its cylinders 21 and is out of service. If the log happens to be short, the orientation units 18 and 17 are utilized, and the upstream end unit 16 is lowered and out of service. In any case, the log L is engaged by only two pairs of the thin discs 23 and 24 and is not contacted during orientation over any wide area and along its full length, as in the prior art. This is a great advantage in proper orientation of the log because the thin discs 23 and 24 will avoid contact with most, if not all, of the log irregularities. Furthermore, in contrast to the prior art as exhibited by the referenced patent, the units 16, 17 and 18 can be individually and independently raised and lowered, again rendering the positioning and orientation of the particular log much more precise because the apparatus is more versatile in its operation. In all cases, a pair only of the three log orientation units is actively used and the positive drive unit 18 is always employed with one or the other of the units 16 or 17.

With particular reference to FIG. 3, the positive drive unit 18 includes a hydraulic motor 25 connected with chain gearing 26 driving a countershaft 27, in turn coupled with and driving additional gearing 28 operatively connected with the drive shafts of toothed discs 24 upon which the log rests. In the orientation process, the toothed discs 24 positively rotate the log L on its longitudinal axis to obtain the optimum position for cutting with minimum waste. The smooth discs 23 merely turn freely when the log is rotated by the toothed discs. This rotational adjustment plus the selective raising and lowering of the orientation units by their cylinders 21 enables the log to be oriented with precision. The orientation mechanism is fully compatible with state-of-the-art microprocessor means or optical scanning means to control the orientation mechanism so that the ideal cutting position of the log can be obtained.

Figure 2:
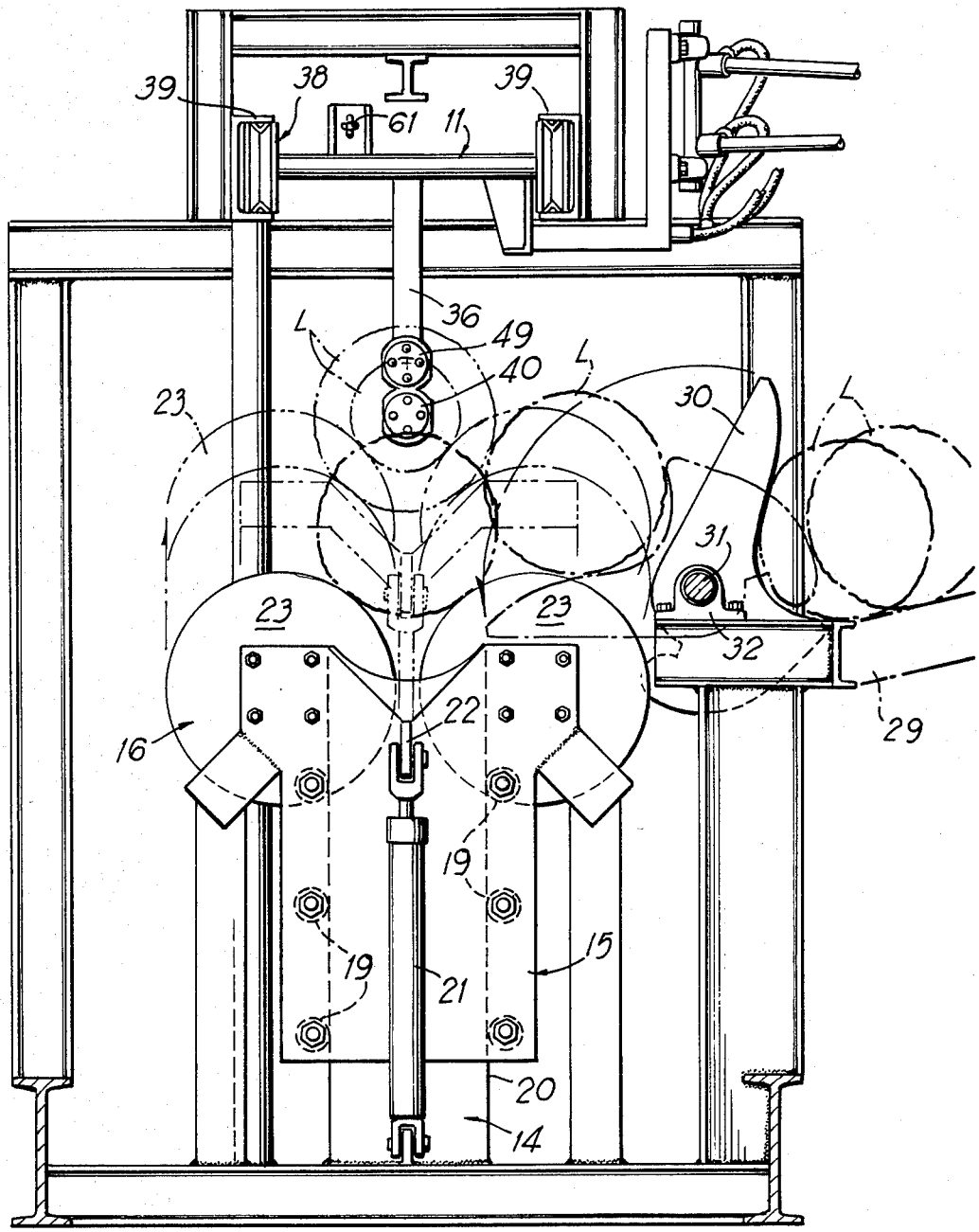
FIG. 2 is a transverse vertical section taken on line 2—2 of FIG. 1.

Each log in succession is delivered onto the orientation units 16, 17 and 18, FIG. 2, by rolling down an inclined ramp 29 into engagement with pivoted trip latches 30 supported by an adjacent horizontal shaft 31, supported by bearings 32 on an elevated frame member 33 of the mill framework. The trip latches 30 yield in one direction when engaged by the log as shown in phantom lines in FIG. 2 to allow the log to enter onto the discs 23 and 24 of the orientation mechanism. After passage of the log, the trip latches 30 return by gravity to their upright positions shown in full lines and prevent the log from moving laterally off of the orientation mechanism because the elements 30 will only yield and rotate in one direction, namely, counterclockwise in FIG. 2.

The previously-noted log dogging, indexing and stabilizing mechanism 11 forming the second major feature of the invention comprises a frame having a top plate 34 and attached depending support arms 35 and 36. The top plate 34 is fixed to an overlying carriage plate 37 of a wheeled transport carriage 38 for the mechanism 11 which traverses horizontal longitudinal channel tracks 39 disposed at an elevation well above the log orientation mechanism, as shown in FIGS. 1 and 2. The arrangement of the transport carriage 38 and rails 39 is essentially as disclosed in U.S. Pat. No. 4,287,798.

The mechanism 11 comprises a rotational indexing dog 40 which engages the upstream end of log L centrally and axially. The dog 40 is carried by a shaft 41 journaled in coaxial bearings 42 attached to the arms 35 and 36 of the carriage structure. A sleeve 43 fixed to the shaft 41 carries a short crank arm 44 coupled to a hydraulic cylinder 45 connected between the crank arm 44 and a fixed arm 46 on the frame of the mechanism 11. The crank arm 44 is rotated at proper times by the cylinder 45 precisely 90° between two spaced stop lugs 47 secured to the frame arm 35. This quarter turn rotation of the crank arm 44 also rotates the shaft 41 and the dog 40 one-quarter turn to index the log L for its second pass through the saw blades to produce the square cross section timber piece 48 from the log L. It may be seen that the quarter-turn indexing of the log is not dependent on the operation of a rotational motor and chain gearing, as in the prior art, and is much more precise and does not require constant adjustment caused by chain slack and development of play in the system.

The mechanism 11 additionally includes a stabilizing dog 49 disposed immediately above the indexing dog 40 on an axis parallel thereto. The axes of the dogs 40 and 49, FIG. 2, occupy a common vertical plane which is coincident with the central axis of the log L.

Figure 7:
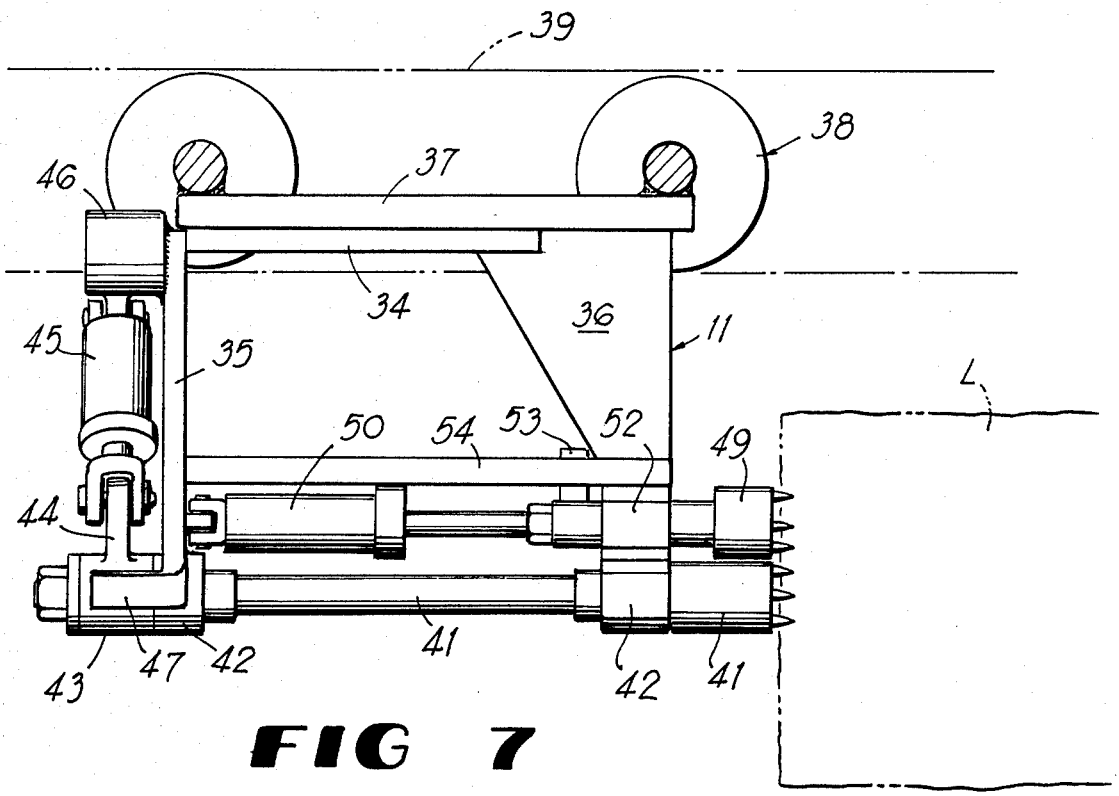
FIG. 7 is a side elevation of such carriage and associated elements.

The stabilizing dog 49 does not rotate but is axially shiftable into and out of engagement with the end face of the log L by a hydraulic cylinder 50 connected to a lug 51 on the arm 35, FIG. 7. The shaft of stabilizing dog 49 reciprocates in a bearing 52 immediately above the bearing 42 and rigid therewith.

The dog 49 is restrained from rotating on its axis by a rigid lug 53 projecting from the shaft of the dog 49 and engaging slidably between a pair of spaced parallel guide bars 54 fixed to the frame arms 35 and 36.

At the far end of the log L, FIG. 1, a freely rotatable dog 55 coaxial with the indexing dog 40 engages the other log end face centrally to support the log in conjunction with the dogs 40 and 49. The rotatable dog 55 is supported on a depending arm 56 of another carriage 57 having guided engagement with the overhead rails 39 and a cooperative top rail 58 as shown in the referenced patent. The two carriages 38 and 57 are moved in opposite directions axially of the log L along the overhead rails by an overhead hydraulic cylinder 59 whose cylinder body is connected at 60 to the carriage 38 and whose rod 61 is connected to the carriage 57 in the same manner disclosed in U.S. Pat. No. 4,287,798.

A suitable hydraulic supply system 62 including hydraulic fluid reservoir and pumping means to supply the several hydraulic cylinders of the mill is located on the upstream end of the base frame 12, as shown in FIG. 1. The supply system 62 is essentially as disclosed in the referenced prior patent.

In the operation of the mill for producing square cross section timber pieces, logs one at a time are delivered onto the orientation mechanism which includes the units 16, 17 and 18 already fully described. Either by visual scanning of each log or with the aid of a state-of-the-art microprocessor system or the like, each log is elevated and aligned horizontally by two of the units of the three unit orientation mechanism. The log is also rotated as required for proper orientation by the toothed discs 24.

When the optimum position of the log is obtained by the orientation mechanism, the dogging mechanism 11 and the downstream dog 55 are engaged with the opposite end faces of the log by operation of the cylinder 59 on the two carriages 38 and 57. As described, the indexing dog 40 and the coaxial downstream dog 55 engage the log along its center axis. The stabilizing dog 49 above the indexing dog is also engaged with the log by operation of the cylinder 50. The stabilizing dog, being engaged with the log at an off-center location, precludes rotation of the log on its axis during transport through the saw blades.

Figure 6:
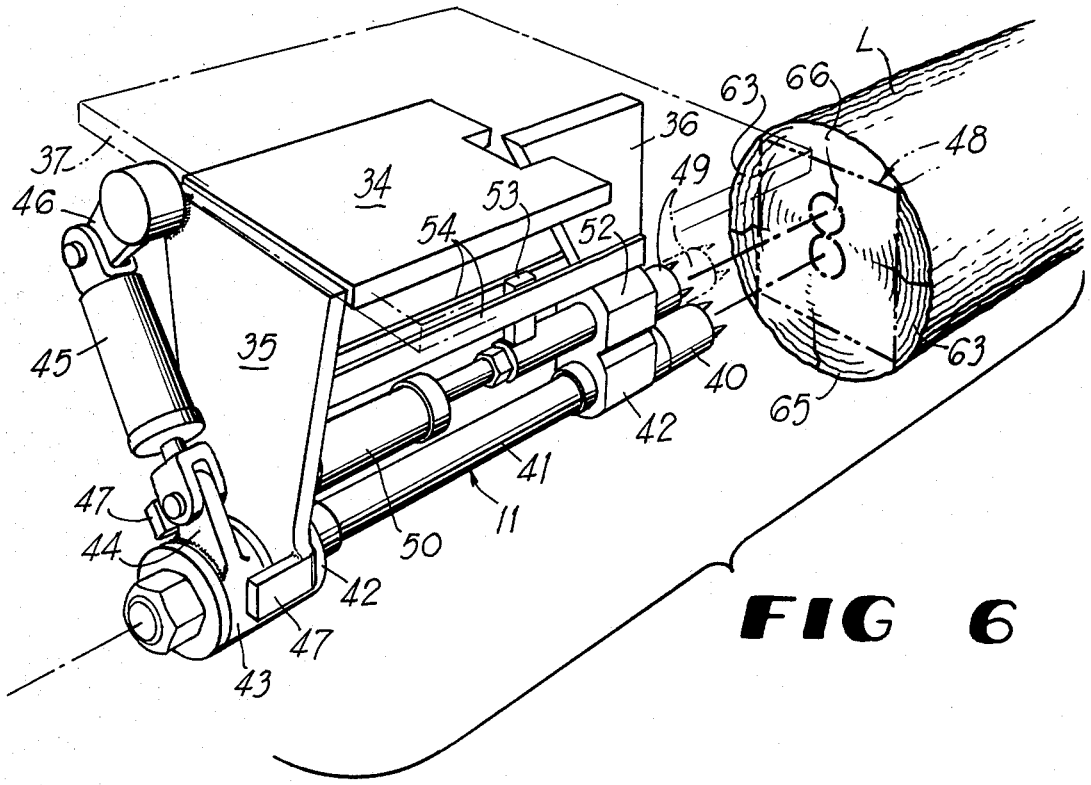
FIG. 6 is a fragmentary exploded perspective view of a log dogging, indexing and stabilizing carriage.

When the log is dogged as described, it is transported once through the saw blades exactly as described in the prior patent to cut opposite side slabs 63, FIG. 6, from the log so as to form opposite side square timber faces 64. Following this, the carriages 38 and 57 with the log are retracted to the position shown in FIG. 1. The stabilizing dog 49 is retracted from the log by its cylinder 50, and the log is indexed precisely 90° by operation of the cylinder 45, following which the stabilizing dog 49 is re-engaged with the log. The log is then conveyed on a second pass through the saw blades and two more slabs 65 and 66 are removed from the log to form the other parallel pair of faces on the finished square cross section timber piece 48. In FIG. 6, the log is shown prior to be indexed by rotation of the indexing dog 40. Each log in succession entering the mill as depicted in FIG. 2 is processed in the same manner first by the orientation mechanism and then by the dogging, indexing and stabilizing mechanism 11. Since the dogs 40 and 49 are narrow and are arranged one above the other, the total width across the two dogs is no greater than it would be if only one dog were employed to index the log as in the prior art. This narrow dimension across the dogs enables close spacing of the saw blades for the efficient production of quite narrow square timber as well as wide timber within a range of sizes which the mill can handle.

It should be noted that when each log L has been dogged by operation of cylinder means 59, the carriages 15 of orientation units 16, 17 and 18 may be lowered to separate the log from the discs 23 and 24 prior to transporting the log on its first pass through the saws.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a saw mill for the production of square cross section timber pieces from rough logs, a log orientation mechanism comprising at least a pair of spaced orientation units each having laterally spaced rotatable log engaging and supporting parallel axis discs, the discs of one orientation unit having rough peripheries adapted to drive a supported log in rotation on its longitudinal axis, power drive means for the discs having the roughened peripheries, power means to independently raise and lower the discs of said orientation units, and a cooperative log dogging, indexing and stabilizing mechanism comprising a pair of spaced units having transport carriages guidingly engaged with overhead support rails for the carriages, and power means connected between the carriages to move the carriages toward and from the opposite end faces of a log resting on said orientation mechanism, a log supporting and indexing dog on one unit of the second-named mechanism, power means on such unit connected with the supporting and indexing dog to index such dog precisely 90° between fixed limit stops, a stabilizing dog on said one unit above the supporting and indexing dog, power means on such unit to move the stabilizing dog on a linear path toward and from engagement with a log end face while precluding rotation of said stabilizing dog, and the second-named mechanism including a second unit spaced from the first unit of said dogging, indexing and stabilizing mechanism and having a freely rotatable log end face engaging dog coaxially aligned with the indexing dog.

2. In a saw mill as defined in claim 1, and said log orientation mechanism comprising three spaced orientation units each having said discs in pairs, the end unit of the orientation mechanism nearest to the saws of the mill having the discs with rough peripheries and having the power drive means for such discs.

3. In a saw mill as defined in claim 2, and each orientation unit including a vertically movable disc carriage and a stationary vertical guideway for the carriage.

4. In a saw mill as defined in claim 3, and said power means to independently raise and lower the discs comprising power cylinder means connected with the vertically movable carriage of each unit of the orientation mechanism.

5. In a saw mill as defined in claim 1, and said power means connected with the supporting and indexing dog comprising a power cylinder on said one unit of the second-named mechanism, a rotational shaft carrying the log supporting and indexing dog, and a crank element on said rotational shaft connected with said power cylinder.

6. In a saw mill as defined in claim 5, and a pair of spaced stop elements on a frame part of said one unit of the second-named mechanism in the path of movement of said crank element to precisely limit indexing of the supporting and indexing dog to one-quarter turn.

7. In a saw mill as defined in claim 6, and the power means to move said stabilizing dog on a linear path comprising a power cylinder connected with the stabilizing dog, and a linear guideway means for the stabilizing dog on said one unit to prevent rotation of the stabilizing dog during its linear movement.

8. In a saw mill as defined in claim 7, and the linear guideway means comprising a pair of spaced parallel guide bars defining a guide slot, and a guide lug attached to the stabilizing dog and being engaged movably within said slot.

9. In a saw mill for producing square cross section timber, a log orientation mechanism comprising a plurality of spaced orientation units, means to elevate and lower each orientation unit separately and independently, a pair of laterally spaced log engaging and supporting rotary disc elements on each orientation unit, power drive means for the pair of disc elements on one endmost orientation unit only of the orientation mechanism, the disc elements on the other orientation units being free turning.

10. In a saw mill as defined in claim 9, and the power driven disc elements on said one endmost orientation unit having toothed peripheries to engage and drive a log in rotation during its orientation.

11. In a saw mill as defined in claim 9, and said plurality of spaced orientation units comprising three substantially equidistantly spaced units, whereby the intermediate unit of the orientation mechanism may be used with said one endmost unit having the power driven discs for the orientation of short logs while the other endmost unit is in a lowered inactive position, and wherein the two endmost units of the orientation mechanism may be used for the orientation of a long log while the intermediate orientation unit is in a lowered inactive position.

12. In a saw mill for producing square cross section timber, a log supporting, indexing and stabilizing transport unit, said unit having an overhead carriage to travel on a linear guideway of the saw mill, a rotational log indexing dog on said transport unit adapted to engage one end face of a log centrally and axially, power means to turn the indexing dog one-quarter turn between spaced fixed stop elements on the transport unit, a log stabilizing dog on the transport unit spaced eccentrically to the axis of the indexing dog and having an axis parallel to the indexing dog axis, and power means on said transport unit coupled with the stabilizing dog to move such dog on a linear path toward and from engagement with a log end face.

13. In a saw mill as defined in claim 12, and the first-named power means to turn said indexing dog comprising a crank arm connected with the indexing dog and being rotationally movable between said fixed stop elements, and a power cylinder coupled between said crank arm and a fixed element of said transport unit.

14. In a saw mill as defined in claim 12, and said power means coupled with the stabilizing dog comprising a power cylinder on said transport unit, and cooperative means connected with the stabilizing dog to resist rotation of the stabilizing dog on its longitudinal axis during movement of the stabilizing dog on said linear path.

15. In a saw mill as defined in claim 14, and said cooperative means comprising a pair of spaced parallel guide bars on said transport unit spaced from and parallel to the axis of the stabilizing dog, and a guide lug fixed on the stabilizing dog and being engaged movably in a guide passage defined by said parallel guide bars.

* * * * *